United States Patent [19]

Pallone

[11] 4,302,884

[45] Dec. 1, 1981

[54] INSIGNIA POSITIONING TEMPLATE

[76] Inventor: Joseph G. Pallone, 6515 LeMans La., Columbus, Ga. 31904

[21] Appl. No.: 117,519

[22] Filed: Feb. 1, 1980

[51] Int. Cl.[3] ..... A41H 3/01

[52] U.S. Cl. ..... 33/180 R; 33/174 G

[58] Field of Search ..... 33/180 R, 190, 174 G

[56] References Cited

U.S. PATENT DOCUMENTS

| | | | |
|---|---|---|---|
| 2,387,986 | 10/1945 | Evans . | |
| 2,681,511 | 6/1954 | Seton | 33/180 R |
| 2,821,787 | 2/1958 | Shepard | 33/180 R |
| 3,376,651 | 4/1968 | Carey | 33/180 R |

*Primary Examiner*—William D. Martin, Jr.
*Attorney, Agent, or Firm*—Richard J. Roddy

[57] ABSTRACT

Military organizations typically have exacting rules relating to the positioning of insignia on the uniforms of their personnel. Inasmuch as the rules are typically exacting, manual efforts to properly position the insignia are at best difficult. Aids have been developed to assist the personnel in the positioning of uniform insignia. However, known aids tend to be difficult to operate or tend to be expensive. My improved template for positioning insignia on a military uniform includes a center line marked thereon; none, one or more than one edge positioning guidelines marked thereon; one or more horizontal positioning lines marked thereon; and one or more longitudinal, horizontal slots therein. The center line and/or edge positioning guidelines are for aligning the template substantially parallel with respect to the uniform neckline. The horizontal positioning lines are for positioning the upper and lower edges of the respective insignia respective predetermined distances below and above a stud, the stud disposed to be in the plane of the center line and to be protruding above and below the otherwise flat surfaced template. The slots are adapted for receiving the spikes typically protruding from the rear of the insignia to be positioned and are adapted for slidably removing the template when the insignia is positioned.

4 Claims, 3 Drawing Figures

INSIGNIA POSITIONING TEMPLATE

TECHNICAL FIELD

This invention relates to templates and, more particularly, to templates for positioning insignia on military uniforms.

BACKGROUND OF THE INVENTION

Military organizations typically promulgate rules and regulations, hereinafter referred to as rules, relating to positioning accoutrements such as insignia on military uniforms. The rules usually require relatively exact positioning of the insignia. For example, the letters "U.S." worn on the collar of the uniform of an U.S. Army officer are currently required by the rules (1) to be positioned ⅝ inch above the vertex of an acute angle formed by the collar and the uniform lapel, (2) to be centered and positioned on a center line passing through the vertex of the acute angle, and (3) to be positioned with the center line being parallel to the uniform neckline. Further, the rules require symmetry of insignia position as between the left and the right collars and lapels. It is no wonder that military personnel have found great difficulty in complying with the rules. It is also no wonder that alternatives are known for assisting personnel in complying with the rules.

For example, U.S. Pat. No. 2,387,986; entitled "Insignia Positioning Device" and issued Oct. 30, 1945; discloses a flat, plastic, transparent, rectangular device with rectangular openings for inserting insignia therethrough and with line graduations marked thereon for ruler-like measuring and aligning the openings in accord with the promulgated positioning rules. When an opening is positioned, the insignia may be inserted through the opening for attaching the insignia to the uniform. The device may thereafter be lifted over the insignia without disturbing the attached and positioned insignia.

U.S. Pat. No. 3,376,651; entitled "Insignia Positioning Device" and issued Apr. 9, 1968; discloses a device having a channel-shaped, clip-on neckline edge for removably securing the device in position on a uniform. The device has upper and lower edges perpendicular to the neckline edge and between which edges there is a slot parallel to the edges. A carrier is longitudinally slidable in the slot. A positioning stud protrudes downward from the carrier and below the device, while a centering arm is mounted on the carrier and above the device. The stud is positioned in the vertex of the acute angle and the clip-on edge is secured to the uniform neckline. The upper and lower insignia are positioned resting against the upper and lower edges of the device and centered using the centering arm, which is pivotally and slidably mounted on the carrier.

Still a search continues for an easily operated and inexpensive template for accurately positioning uniform insignia.

SUMMARY OF THE INVENTION

This and other objects are achieved in accordance with the principles of my invention by an improved template for positioning insignia on a military uniform. The template includes a vertical center line marked thereon, a first horizontal positioning line marked thereon, and at least one opening therein. According to one aspect of my invention, the template includes a stud protruding above and below the template and in the plane of the center line and further includes the first horizontal line being disposed to be a first distance vertically above the stud for positioning the lower edge of the upper insignia the first distance above the stud. The template still further includes a longitudinal, horizontal slot disposed to be a first slot distance above the stud and adapted for receiving the spikes of an upper insignia therethrough and adapted for slidably removing the template when the upper insignia is positioned. According to a second aspect of my invention, the template includes a second horizontal positioning line being disposed to be a second distance vertically below the stud for positioning the upper edge of a lower insignia the second distance below the stud. The template also includes one or more openings, each opening being a longitudinal, horizontal slot disposed to be a respective slot distance below the stud and adapted for receiving one or more spikes of an insignia to be positioned and adapted for slidably removing the template when the lower insignia is positioned.

BRIEF DESCRIPTION OF THE DRAWING

My invention should become fully apparent when taken in connection with the accompanying detailed description and the accompanying drawing in which.

DETAILED DESCRIPTION

Figure 1:
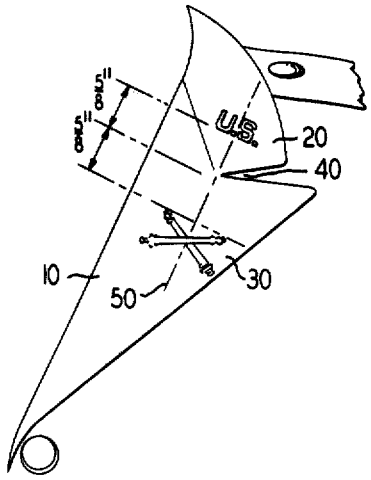
FIG. 1 illustrates a typical military uniform with insignia illustratively positioned thereon.

Referring to FIG. 1, a typical military uniform includes neckline 10, collar 20, and lapel 30. Collar 20 and lapel 30 are usually separated by a V-shaped notch in the form of acute angle 40. An upper insignia, here illustratively the letters "U.S.", is usually positioned with its lower edge situated, or disposed to be, a first predetermined distance, here ⅝ inch, above the vertex of angle 40. Similarly, a lower insignia, here illustratively the crossed cannons of the field artillery branch of the U.S. Army, is positioned with its upper edge situated a second predetermined distance, here also ⅝ inch, below the vertex of angle 40. Also, the upper and lower insignia are centrally positioned on center line 50, which passes through the vertex of acute angle 40. Too, the upper and lower insignia are positioned with center line 50 being parallel to neckline 10.

Figure 2:
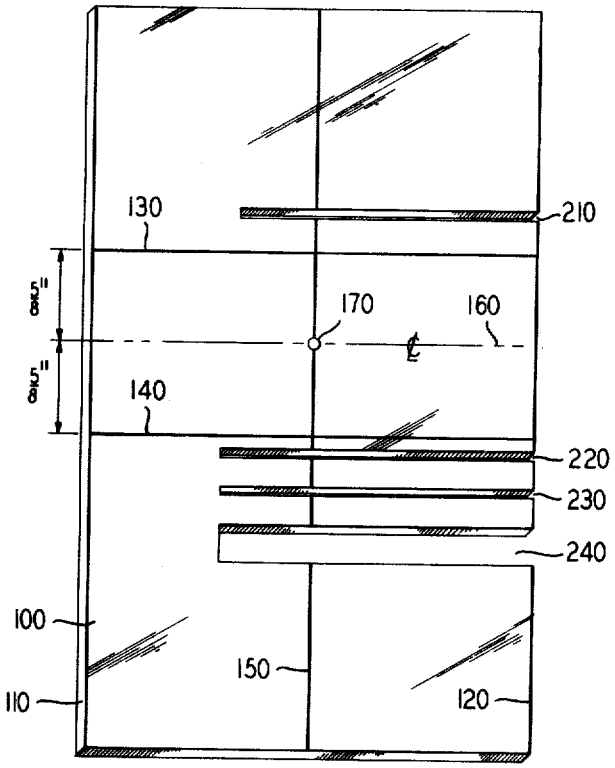
FIG. 2 illustrates a template in accord with the principles of my invention.

Referring to FIG. 2, my illustrative template 100 is an easily operated and inexpensive template for accurately positioning uniform insignia. Template 100 may be constructed of plastic, transparent material and may be shaped to a flat surfaced, rectangular size of about two horizontal inches-by-four vertical inches with a thickness allowing flexibility and yet durability, for example, with a thickness of about 1/16 inch. Marked conspicuously on template 100 are none, one, or more than one vertical edge guidelines, here two edge guidelines are shown, i.e. guidelines 110 and 120, which are substantially parallel with vertically marked center line 150. Marked edge guidelines 110 and 120 and/or marked center line 150 are for easy parallel aligning of center line 150 with neckline 10. Also marked on template 100 are horizontal position guidelines 130 and 140, which are perpendicular to marked center line 150 and which are parallel to unmarked center line 160 and which are a first and a second predetermined distance, respectively, above and below unmarked center line 160 and hence, as will shortly be made more clear, above and below stud 170. Here, illustratively and in accord with the principles of my invention as a reflection of current positioning rules, the first and the second predetermined distances are each ⅝ inch. Marked position guidelines 130 and 140 are for accurately positioning the insignia edges a respective predetermined above and below the vertex of angle 40. Each of the position guidelines, edge guidelines, and center line markings may be any color or means, for example the color black, for allowing easy visual distinction among template, insignia and uniform. Situated at the intersection of marked center line 150 and unmarked center line 160 is stud 170. Stud 170 may be a cylindrically shaped device having a diameter of about 1/32 inch and protruding a distance of about ⅛ inch above and below otherwise flat surfaced template 100. Although described hereinafter, template 100 also includes slots 210, 220, 230, and 240, which are adapted for receiving the various insignia to be positioned and for slidably removing the template when the insignia are positioned.

Figure 3:
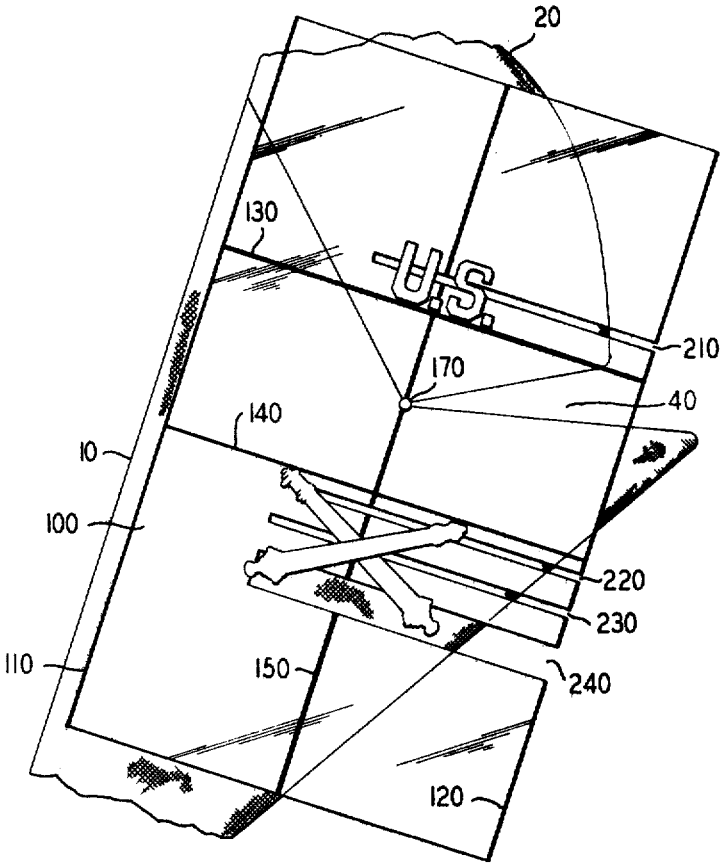
FIG. 3 illustrates the template of FIG. 2 lain upon the typical military uniform of FIG. 1 prior to positioning the insignia.

FIG. 3 is useful in further describing my improved template 100. Template 100 may be lain on uniform lapel 30 with protruding stud 170 inserted in the vertex of angle 40. Template 100 may thereafter be rotated either clockwise or counter-clockwise, pivoting around stud 170, until edge guideline 110, or alternatively marked center line 150, is relatively juxtaposed but substantially parallel to neckline 10. It should be clear that marked center 150 is then also substantially coincident with uniform center line 50.

As to attaching the insignia to the uniform, it is well known that military insignia include one or more spikes protruding from the rear of the insignia. The spikes usually resemble small nails. Functionally, when the insignia are pressed, for example by a human thumb, against the uniform the spikes typically penetrate through the cloth of the uniform. When so penetrated, retainer devices (not shown), which commonly include holes into which the spikes may be slidably inserted, are attached thereto for securing the the insignia to the uniform. Thus, the insignia are attached to the uniform.

Unfortunately, the spikes are usually situated at different positions on different insignia. For example, some insignia such as the letters "U.S." are designed with the spikes being in a plane substantially parallel with the upper and lower edges of the insignia. Other insignia, such as the crossed cannons of the field artillery branch of the U.S. Army, are designed with spikes in two or more planes, each plane usually being parallel to the upper and lower edges of the insignia. As to the crossed cannons, the spikes are usually protruding from the rear of one of the two cannons, and hence are on still another plane, e.g. a plane which is diagonal with respect to the upper and lower edges of the insignia. To overcome this and other problems, my improved template 100 includes a plurality of slots, here slots 210, 220, 230, and 240, for positioning a wide variety of insignia.

For example, as to positioning the upper insignia, after template 100 is, as aforedescribed, lain in a position parallel to neckline 10, the spikes of the upper insignia are received through slot 210. The lower edge of the upper insignia may be positioned abutting position guideline 130 with the center of the upper insignia substantially coincident with center line 150. When so positioned, the upper insignia is a first predetermined positioning distance above stud 170. Also, when so positioned, thumb pressure on the insignia forces its spikes to penetrate through the cloth of collar 20 for ready fitting into the holes of the retainer device (not shown). Of course, template 100 may include more than one slot above unmarked center line 160. However, in my illustrative embodiment, only one longitudinal, horizontal slot, i.e. slot 210, is included. Slot 210 is disposed to be in the plane of an insignia spike and is located a first predetermined slot distance above unmarked center line 160, and hence above stud 170. Here, the lower edge of slot 210 is located about ⅞ inch above center line 160 and stud 170, is a predetermined width, here slot 210 is a width of about 1/16 inch, and further is a predetermined length, here slot 210 extends from an opening at edge guideline 120 toward center line 150 and therebeyond a distance of about ½ inch in the direction of edge guideline 110. Such a slot 210 obtains for easy and accurate positioning of the typical, although not only, upper insignia, i.e. the letters "U.S.".

As to positioning the lower insignia, after template 100 is, as aforedescribed, positioned parallel to neckline 10, the spikes of the lower insignia are received through one or more slots 220, 230, and 240. The upper edge of the lower insignia may be positioned abutting position guideline 140 with the center of the lower insignia substantially coincident with marked center line 150. When so positioned, the lower insignia is a second predetermined positioning distance below stud 170. Also, when so positioned, thumb pressure on the insignia forces its spikes to penetrate through the cloth of lapel 30 for ready fitting into the holes of the retainer device (not shown). Of course, template 100 may include one or more slots below unmarked center line 160, and hence below stud 170. However, in my illustrative embodiment, three longitudinal, horizontal slots, i.e. slots 220, 230, and 240, are included. Each slot is disposed to be in the plane of an insignia spike and is located a respective predetermined distance below unmarked center line 160, and hence below stud 170. Here, the upper edge of slot 220 is located about ¾ inch below unmarked center line 160, while the upper edge of slot 230 is located about one inch below unmarked center line 160, and the upper edge of slot 240 is located about one and one-quarter inches below unmarked center line 160. Also, each slot is a respective predetermined width. Here, slots 220 and 230 are each about 1/16 inch wide while slot 240 is about ¼ inch wide. Further, each slot is a respective predetermined length. Here, each of slots 220, 230, and 240 is the same length, the length extending from an opening at edge guideline 120 toward center line 150 and therebeyond a distance of about ½ inch in the direction of edge guideline 110. Three such sized slots obtain easy and accurate positioning of a wide variety of typical lower insignia.

After the insignia are thusly positioned and securely attached to the uniform, another feature of my template comes to use, i.e. movement of template 100 toward neckline 10 allows for its slidable removal after the insignia are positioned. Importantly, the insignia are thusly properly positioned using my easily operated and inexpensive template 100.

Although my invention has been described and illustrated in detail, it is to be understood that the same is not by way of limitation. For example, the description of my invention is as to positioning an insignia on the left collar and the left lapel of a uniform. It should be eminently clear that, by rotating my template 100 about an axis coincident with marked center line 150, my template 100 is adapted for positioning insignia on the right collar and the right lapel of the uniform. This insures symmetrically correct placement of the left and right collar and lapel insignia in accord with the promulgated rules and regulations. Also, slots 210, 220, 230 and 240 may be situated at different predetermined distances than as aforedescribed to adapt my template for positioning still other insignia, each distance corresponding to the plane of at least one spike. Accordingly, the spirit and scope of my invention is limited only by the terms of the appended claims.

I claim:

1. A template (100) for positioning insignia on a uniform, said template including a vertical center line (150) marked thereon, a first horizontal line (130) marked thereon, and at least one opening therein and characterized in that said template further comprising a stud (170) protruding above and below said template and disposed to be in the plane of said center line;

said template being adapted to be lain on said uniform and being adapted to rotate and pivot about said stud;

said first horizontal line being a positioning line and being disposed to be a first predetermined positioning distance above said stud and being substantially perpendicular to said center line; and a first opening being a longitudinal, horizontal slot (210), said slot being disposed to be a first predetermined slot distance above said stud and being adapted for receiving at least one spike of an insignia to be positioned and being adapted for slidably removing said template when said insignia is positioned whereby said template in being lain on said uniform and by being rotated until said center line is substantially parallel to a neckline of said uniform achieves a template situated sufficiently close to the uniform lapel to allow the insignia spikes to penetrate the lapel and pass through the uniform cloth so that retainer devices may be slidably inserted on the spikes for securing the insignia to the uniform.

2. The template defined in claim 1 further comprising:

a second horizontal line (140) marked thereon, said second horizontal line being a positioning line and being disposed to be a second predetermined positioning distance below said stud and being substantially perpendicular to said center line; and each of said openings being a longitudinal, horizontal slot (220,230,240), said slot being disposed to be a respective predetermined slot distance below said stud and being adapted for receiving at least one spike of an insignia and being adapted for slidably removing said template when said insignia is positioned.

3. The template defined in claim 2 further comprising:

each respective one of said openings being a respective longitudinal, horizontal slot of respective predetermined length and of respective predetermined width.

4. The template defined in claim 2 wherein said template further comprises:

a generally rectangular device of transparent material with said center line and with said positioning lines being conspicuously marked thereon; and at least one edge guideline (110,120), said edge guideline being substantially parallel with said center line and being disposed to be conspicuously marked on said template for ready visual alignment of said template during the positioning of the insignia.

* * * * *